US009528328B2

(12) United States Patent
Rytlewski et al.

(10) Patent No.: US 9,528,328 B2
(45) Date of Patent: Dec. 27, 2016

(54) PASSIVE OFFSHORE TENSION COMPENSATOR ASSEMBLY

(71) Applicant: Schlumberger Technology Corporation, Sugar Land, TX (US)

(72) Inventors: Gary L. Rytlewski, League City, TX (US); Laure Mandrou, Bellaire, TX (US); Peter Nellessen, Jr., Palm Beach Gardens, FL (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 275 days.

(21) Appl. No.: 13/672,347

(22) Filed: Nov. 8, 2012

(65) Prior Publication Data

US 2013/0192844 A1 Aug. 1, 2013

Related U.S. Application Data

(60) Provisional application No. 61/593,158, filed on Jan. 31, 2012.

(51) Int. Cl.

| | |
|---|---|
| ***E21B 43/01*** | (2006.01) |
| ***E21B 34/00*** | (2006.01) |
| ***E21B 34/10*** | (2006.01) |
| ***E21B 29/00*** | (2006.01) |
| ***E21B 34/06*** | (2006.01) |
| ***E21B 19/00*** | (2006.01) |
| ***E21B 17/07*** | (2006.01) |

(52) U.S. Cl.

CPC ..... *E21B 19/004* (2013.01); *E21B 17/07* (2013.01); *E21B 43/0107* (2013.01)

(58) Field of Classification Search

None

See application file for complete search history.

(56) References Cited

U.S. PATENT DOCUMENTS 3,211,224 A * 10/1965 Lacy ..... E21B 17/01 166/355
3,643,751 A * 2/1972 Crickmer ..... E21B 17/01 166/355

(Continued)

FOREIGN PATENT DOCUMENTS

WO WO0177483 10/2001

OTHER PUBLICATIONS

International Search Report and Written Opinion mailed May 15, 2013 for International Application No. PCT/US2013/023064, 11 pages.

(Continued)

*Primary Examiner* — Matthew R Buck
*Assistant Examiner* — Douglas S Wood
(74) *Attorney, Agent, or Firm* — Tuesday Kaasch

(57) ABSTRACT

A tensions compensator assembly for a slip type joint in an offshore work string. The assembly includes a chamber at the joint which is constructed in a manner to offset or minimize a pressure differential in a production channel that runs through the work string. Thus, potentially very high pressures running through the string are less apt to prematurely force actuation and expansiveness of the slip joint. Rather, the expansive movement of the joint is more properly responsive to heave, changes in offshore platform elevation and other outside forces of structural concern.

15 Claims, 6 Drawing Sheets

(56) References Cited

U.S. PATENT DOCUMENTS

| | | | | |
|---|---|---|---|---|
| 4,911,242 | A * | 3/1990 | Hromas | E21B 34/10 166/317 |
| 6,216,789 | B1 | 4/2001 | Lorsignol et al. | |
| 7,318,480 | B2 * | 1/2008 | Hosie | E21B 33/035 166/255.2 |
| 7,624,792 | B2 * | 12/2009 | Wright | E21B 33/06 137/68.11 |
| 8,746,351 | B2 * | 6/2014 | Wright | E21B 19/006 166/344 |
| 2003/0102134 | A1 | 6/2003 | Reynolds | |
| 2008/0271896 | A1 * | 11/2008 | Inderberg | E21B 17/07 166/355 |
| 2011/0005767 | A1 | 1/2011 | Muff et al. | |

OTHER PUBLICATIONS

Exam Report under Section 18(3) issued on Jun. 16, 2015 in corresponding GB application No. GB1410915.1; 3 pages.

* cited by examiner

PASSIVE OFFSHORE TENSION COMPENSATOR ASSEMBLY

PRIORITY CLAIM/CROSS REFERENCE TO RELATED APPLICATION(S)

This patent Document claims priority under 35 U.S.C. §119 to U.S. Provisional App. Ser. No. 61/593,158, filed on Jan. 31, 2012 and entitled, "Tension Compensator", which is incorporated herein by reference in its entirety.

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout the productive life of the well. That is to say, from a cost standpoint, an increased focus on ready access to well information and/or more efficient interventions have played key roles in maximizing overall returns from the completed well. By the same token, added emphasis on completions efficiencies and operator safety may also play a critical role in maximizing returns. That is, ensuring safety and enhancing efficiencies over the course of well testing, hardware installation and other standard completions tasks may also ultimately improve well operations and returns.

Well completions operations do generally include a variety of features and installations with enhanced safety and efficiencies in mind. For example, a blowout preventor (BOP) is generally installed at the well head in advance of the myriad of downhole hardware to follow. Thus, a safe and efficient workable interface to downhole pressures and overall well control may be provided. However, added measures may be called for where the well is of an offshore variety. That is, in such circumstances control at the seabed is maintained so as to avoid uncontrolled pressure issues rising to the offshore platform several hundred feet above.

One of the common concerns in the offshore environments in terms of maintaining well control at the seabed relates to challenges of heave and other natural motions of a floating vessel platform. That is, in most offshore circumstances, the well head, BOP and other equipment are found secured to the seabed at the well site. A tubular riser provides cased route of access from BOP all the way up to the floating vessel. However, also secured to the seabed equipment and running up through the riser is a landing string for providing controlled work access to the well. The landing string is of generally rigid construction configured with a host of tools directed at testing, producing or otherwise supporting interventional access to the well. As a result, the string is prone to being damaged in the event of large sways or heaving of the floating offshore platform.

Unfortunately, damage to the tubular landing string while the well is flowing may result in an uncontrolled release of hydrocarbons from the well. That is, a breach in the tubular landing string which draws from the well will likely result in production from the well leaking into the surrounding riser. Making matters worse, the riser extends all the way up to the platform as indicated above. Thus, uncontrolled hydrocarbon production is likely to reach the platform. Setting aside damaged equipment and clean-up costs, this breach may present catastrophic consequences in terms of operator safety.

In order to help avoid such catastrophic consequences, efforts are often undertaken to help minimize the amount of heave or motion-related stress to which the work string is subjected. For example, the string may be managed from the floor of the platform by way of an Active Heave Draw (AHD) system. Such a system may operate by way of rig-based suspension of equipment that is configured to modulate elevation in concert with potential shifting elevation of the floating platform. Thus, as the platform rises or falls, the system may work with excess cabling and hydraulics to responsively maintain a steady level of the work string.

Unfortunately, AHD systems of the type referenced rely on active maneuvering of equipment components in order to minimize the effects of heave on the work string. For example, a sufficient power source, motor and electronics operate in a coordinated real-time fashion to compensate for the potential shifting elevation of the platform. Accordingly, in order for the system to remain effective, each of these components must also remain continuously functional. Stated another way, even so much as a temporary freeze-up of the software or electronics governing the system may result in a lock-up of the entire system. When this occurs, compensation for potential heaves of the platform relative the work string is lost, thereby leaving the string subject to potential over pull and breach as noted above.

The problems of potential breach in the work string are often exacerbated where the floating platform is in a relatively shallow environment. For example, where the water depth is under about 1,000 feet, a single foot of heave may result in damage or breaking of the string if no compensation is available. By way of comparison, the same amount of heave may result in no measurable damage where the string is afforded the stretch that's inherent with running several thousand feet before reaching the equipment at the sea bed. Ultimately, this means that in the shallower water environment, operators are more prone to having to manage a breach in the case of lost active compensation and are afforded less time to deal with such a possibility. That is, in shallower waters, uncontrolled hydrocarbons may reach the platform in a matter of seconds.

SUMMARY

A tubular joint assembly is disclosed for use in an offshore environment. The assembly includes an upper tubular that is connected to an offshore platform. A lower tubular is coupled to a well at a seabed. Further, a compensation chamber is defined by the tubulars at a coupling location where the tubulars are joined together. Thus, the chamber may be set to minimize any pressure differential relative an adjacently disposed production channel that runs through the assembly.

DETAILED DESCRIPTION

Embodiments are described with reference to certain offshore operations. For example, a semi-submersible platform is detailed floating at a sea surface and over a well at a seabed. Thus, a riser, landing string and other equipment are located between the platform and equipment at the seabed, subject to heave and other effects of moving water. However, alternate types of offshore operations, notably those utilizing a floating vessel, may benefit from embodiments of a passive compensator joint assembly as detailed herein. In particular, the assembly includes a compensation chamber that not only allows for expansion of the landing string as needed but also does so in a manner that accounts for pressure buildup within the production channel of the landing string itself. Thus, premature expansion may be avoided, thereby improving stability and life for the string and other adjacent operation equipment.

Figure 1:
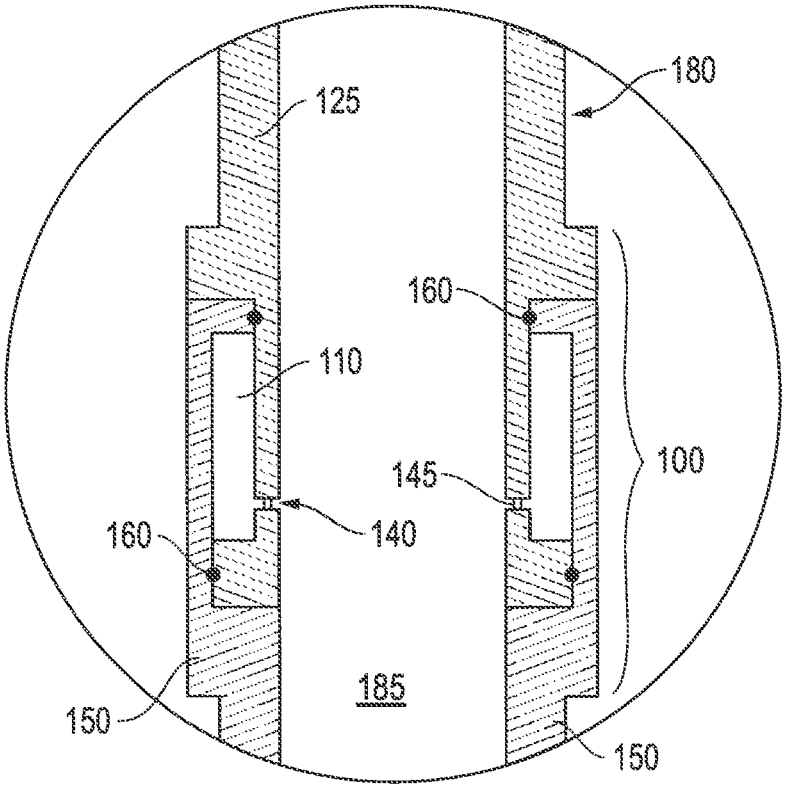
FIG. 1 is an enlarged view of an embodiment of a tubular joint assembly equipped with passive tension compensator capacity.

Referring now to FIG. 1, an enlarged view of an embodiment of a tubular joint assembly 100 is shown. The assembly 100 is equipped with passive tension compensator capacity as detailed hereinbelow. This means that separate portions 125, 150 of a tubular 180 may, to a certain degree, controllably separate from one another without breaking or separating the tubular 180. For example, see FIGS. 4A and 4B with emerging separation (S). This may occur in response to heave-type forces that often take place in an offshore environment such as where a floating vessel 200 rises or sways at a sea surface 205 with the noted tubular 180 tethered therebelow (see FIG. 2).

Returning to the embodiment of FIG. 1, the joint 100 is depicted as an enlarged region of the tubular 180. However, such increased profile is not required. More importantly, the tension compensator capacity is made available by way of a compensation chamber 110. Specifically, this chamber 110 is defined by the coupling of the separate portions 125, 150 of the tubular 180. With added reference to FIG. 2, the separate portions 125, 150 may be referred to as first and second or upper 125 and lower 150 tubulars, which are part of a larger overall string tubular 180. Regardless, the compensation chamber 110 is located at this joint 100 so as to serve as a counterbalance to a given pressure within the channel 185 that runs through the string tubular 180. For example, downhole pressure in the channel 185 may be several thousand PSI. Thus, in theory, where a joint is provided to allow for separation of the tubulars 125, 150, such pressure may begin to force the separation to occur prematurely and in a manner unrelated to any heave or elevation changes in the offshore platform 200. However, as alluded to above and detailed further below, the chamber 110 may be configured in a manner that counterbalances such pressures to a degree.

The compensation chamber 110 of the joint 100 may be precharged or chargeable to a chamber pressure that is determined or selected in light of likely downhole pressure within the channel 185. So, for example, where pressure in the channel is estimated or detectably determined to be at about 10,000 PSI, a fluid such as water within the chamber 110 may similarly be pressurized to about 10,000 PSI. Thus, while 10,000 PSI of pressure within the channel 185 might tend to force the tubulars 125, 150 apart from one another, this same amount of pressure in the chamber 110 will serve as a counterbalance and keep the tubulars 125, 150 together. As such, any separating of the tubulars 125, 150 is likely to be the result of forces outside of high pressure within the channel 185.

Figure 2:
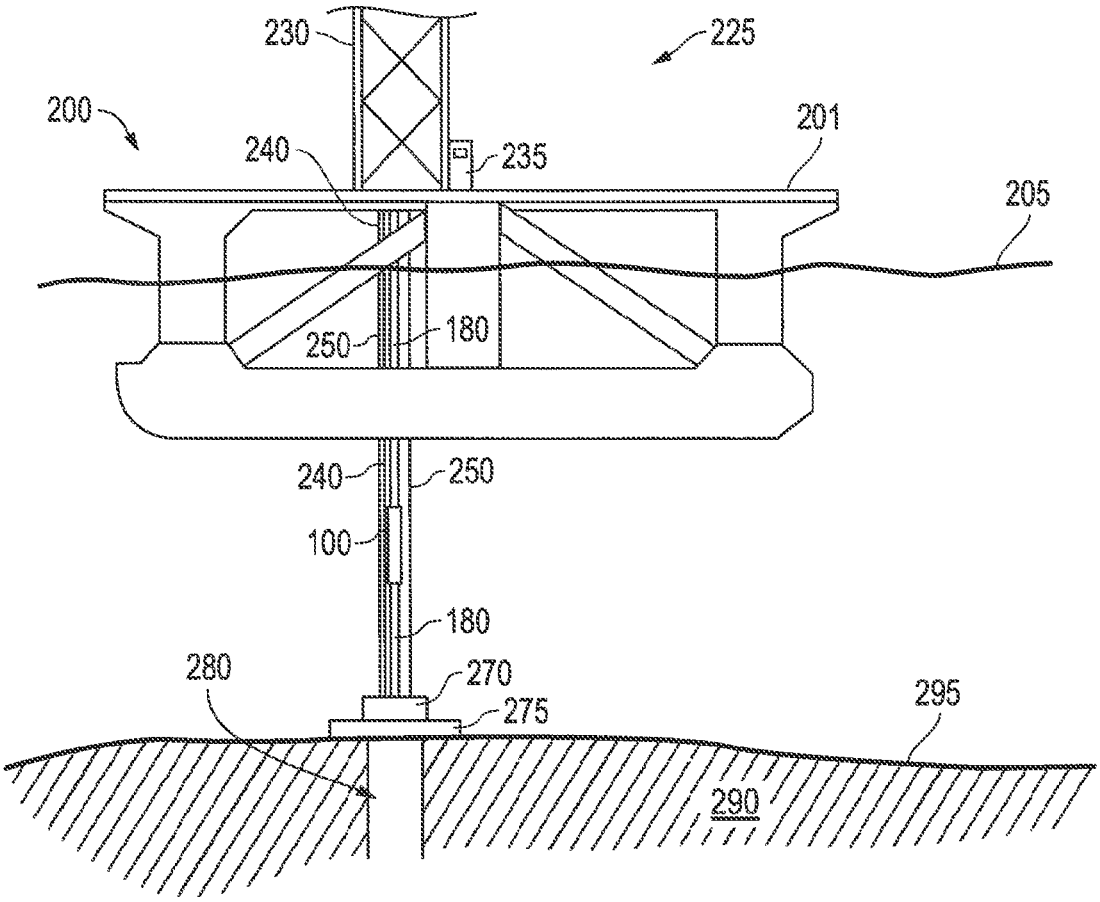
FIG. 2 is an overview of an offshore oilfield environment making use of the assembly of FIG. 1.

Of course, at some point, these other outside forces such as heave and changing elevation of the offshore platform 200 of FIG. 2 may force a separation of the tubulars 125, 150 from one another. That is, setting aside the possibility of premature separation, the joint 100 is meant to separate to a certain degree upon encountering certain outside forces. Yet, the separation is controlled such that breakage of the string 180 may be avoided. Thus, the integrity of the channel 185 may be preserved so as to prevent production fluids from reaching the surface in a hazardous and uncontrolled fashion.

With added reference to FIG. 2 and as indicated above, outside forces may begin to effect an upward pull or stretch on the upper tubular 125 relative the lower tubular 150. Now setting aside pressure effect on the tubulars 125, 150, these outside forces may alone result in movement upward of the upper tubular 125 and an increasing pressure within the chamber 110. As shown in FIG. 1, a port 140 between the chamber 110 and the channel 185 is occluded by a rupture disk 145. Thus, where the differential between the chamber 110 and channel 185 remains below a predetermined level, say about 1,000 PSI, the tubulars 125, 150 will fail to separate. That is, the minimal pull will be countered by a minimal increase in pressure within the chamber 110 which may promote keeping the tubulars 125, 150 together. Stated another way, premature separation is discouraged until differential actuation is achieved. Thus, unnecessary shifting of large tubular heavy equipment may be avoided. Accordingly, unnecessary wear on the tubular 125, 150, an adjacent umbilical 240 and other equipment may also be avoided.

However, where the outside forces rise to a level of concern, for example, imparting a differential in excess of about 1,000 PSI relative the chamber 110, the disk 145 will burst. Specifically, the burst rating of the disk 145 is set at a tension level that is below what would amount to concern over the structural integrity of the string 180. Once more, pressure actuated chamber barriers other than rupture disks 145 may be utilized, such as tensile members set to similar ratings. Regardless, freedom of movement between the tubulars 125, 150 in response to outside forces is now allowed. Indeed, a stable, seal-guided, free-moving interfacing between the tubulars 125, 150 may now be allowed (see O-rings 160). Thus, the joint 100 serves to keep the likelihood of rupture or breakage of the string 180 to a minimum. That is, the joint 100 is tailored to both avoid premature wear-inducing separation at the outset while also subsequently serving the function of helping to avoid potentially catastrophic failure of the string 180.

Continuing now with specific reference to FIG. 2, an overview of an offshore oilfield environment is depicted which makes use of the joint assembly 100 of FIG. 1 as detailed hereinabove. Indeed, a semi-submersible platform 200 is shown positioned over a well 280 which traverses a formation 290 at a seabed 295. A variety of equipment 225 may be accommodated at the rig floor 201 of the semi-submersible 200, including a rig 230 and a control unit 235 for directing a host of applications. For example, in the embodiment shown, a landing string 180 is run from the rig floor 201 and through a riser 250 down to equipment at the seabed 295 such as a subsea test tree inside the blowout preventor (BOP) 270 and well head 275. Thus, operations in the well 280 may take place as directed from the control unit 235 via the string 180.

As depicted in FIG. 2, the riser 250 provides a conduit through which the landing string 180 and an umbilical 240 may be run. For example, the umbilical 240 may include cabling for power and/or telemetric downhole support to the string 180 and elsewhere. However, unlike the string 180, the riser 250 is a mere structural conduit and provides no controlled uptake of fluids. Thus, any hazardous production fluids from the well 280 are routed through the string 180.

Furthermore, the joint assembly 100 detailed hereinabove is provided to avoid the potentially catastrophic circumstance of a breached string 180 that could result in an uncontrolled rush of hydrocarbons to the rig floor 201 via the riser 250. That is, where the semi-submersible sways or rises at the sea surface 205, the stretch or pull on the string 180 is likely to do no more than activate the joint 100. Thus, an expansive separation may be allowed for which results in a slight lengthening of the string 180 as opposed to a hazardous breaking thereof.

Figure 3:
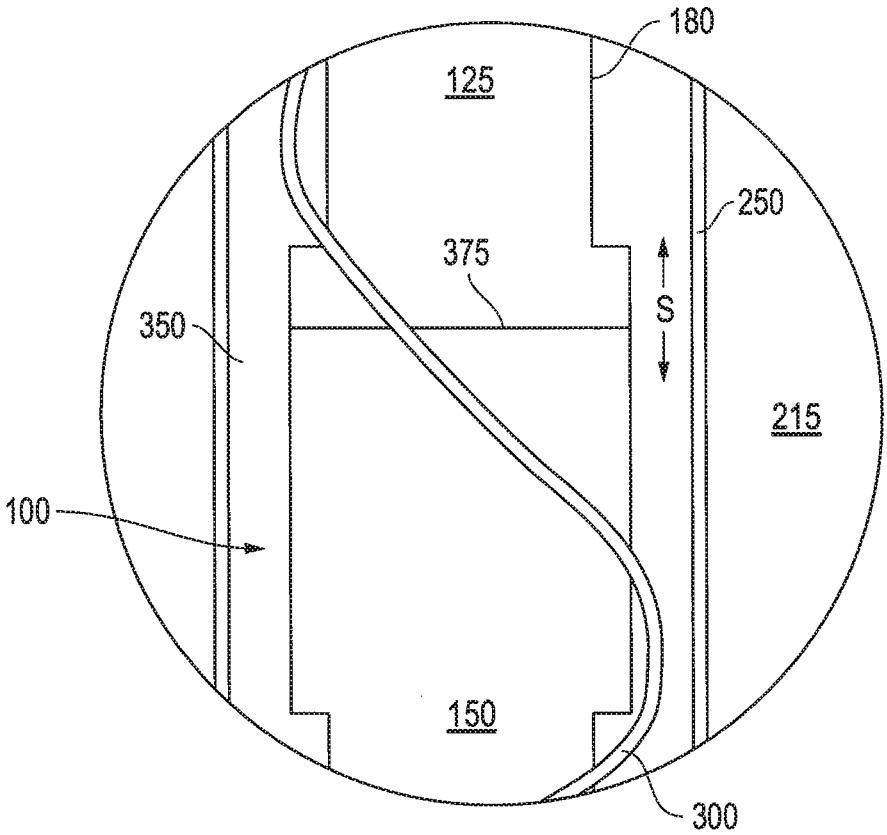
FIG. 3 is another enlarged view of the assembly of FIG. 1 with adjacent slacked umbilical within a riser of FIG. 2.

Referring now to FIG. 3, the potential lengthening of the string 180 within the riser 250 is examined more closely. Specifically, the string 180 and joint assembly 100 are depicted with respect to an adjacent slacked umbilical 300 also disposed within a riser 250. In offshore operations, the umbilical 300 may serve to provide a variety of telemetric, power and/or electric cabling, hoses or other line structure as a single conglomerated form as opposed to running a host of separate lines strewn about the annular space 350.

Further, in the embodiment of FIG. 3, the umbilical 300 may be slacked as indicated. That is, rather than being brought to a taught state along the string 180, between the platform 201 and seabed 295, a degree of slack may be provided. Indeed, in the embodiment shown, slack is notably apparent over the joint assembly 100 of the string 180. In this manner, as conditions dictate the emergence of a separation (S) between the tubulars 125, 150 relative their outer interfacing 375, the umbilical 300 may have sufficient play so as to straighten and avoid any stretching damage thereto.

As detailed hereinabove, the joint assembly 100 works to help avoid potentially catastrophic failure of the string 180. However, the depiction of FIG. 3 also reveals the advantage of avoiding premature and unnecessary wear-inducting separation. For example, the embodiment of FIG. 3 includes an umbilical 300 that is slacked in a manner to help avoid stretch related damage should a separation (S) emerge with a stroking expansion of the joint assembly 100. However, the umbilical 300 is sandwiched within an annular space 350 between a large heavy string 180 and riser 250. Thus, avoiding any unnecessary premature separation (S) in the first place also helps avoid frictional wear and other stresses that may be placed on the umbilical 300, regardless of the potential slack involved.

Figure 4B:
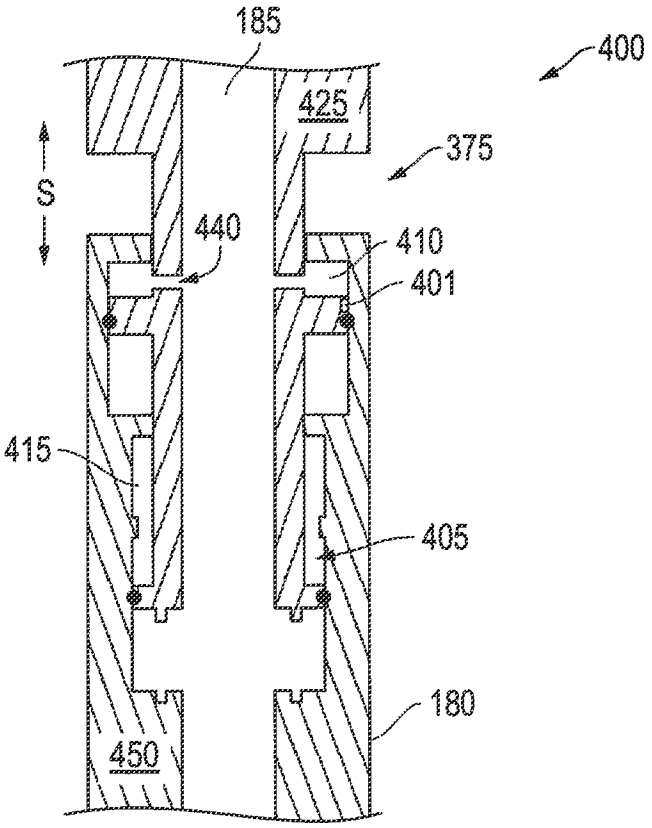
FIG. 4B is an enlarged view of the embodiment of FIG. 4A with gas spring depicted during tension compensating.
Figure 4A:
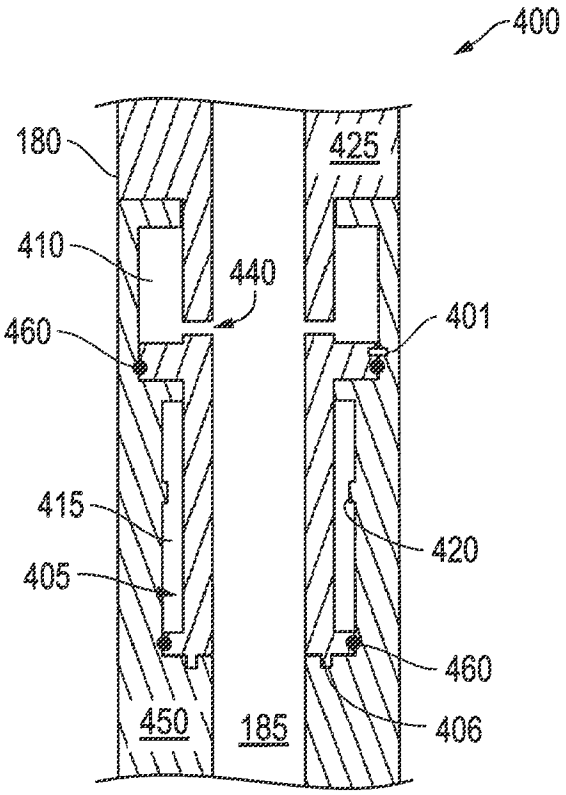
FIG. 4A is an enlarged view of an alternate embodiment of the assembly equipped with a gas spring in advance of tension compensating.

Referring now to FIGS. 4A and 4B, enlarged views of an alternate embodiment of a joint assembly 400 are depicted. More specifically, in these embodiments, the joint assembly 400 is equipped with a gas spring 405. Thus, as the joint assembly 400 begins to stroke, the degree of separation (S) continues to be dynamically regulated.

The joint assembly depicted in FIG. 4A is specifically shown in advance of any stroking of the joint assembly 400 or separation (S) of the noted tubulars 425, 450. In fact, a reversible locking mechanism 401 is shown which immobilizes the lower tubular 450 relative the upper 425. So, for example, during hardware installation and in advance of any production fluids in the channel 185, the tubulars 425, 450 may be tightly secured relative one another. Thus, unintentional or premature separation (S) may be avoided during the transport and installation of such massively heavy equipment between the rig 200 and seabed 295 (see FIG. 2). However, as shown in FIG. 4B, and discussed further below, the locking mechanism 401 may be unlocked and the joint assembly 400 readied for use. Again this may involve seal-guided movement via O-rings 460. Additionally, a torque transmitting connection 406 may be provided with matching dogs and recesses along with a host of other pairing features.

Continuing with reference to FIG. 4A, the joint assembly 400 includes a compensation chamber 410 with a port 440 allowing fluid communication from the channel 185 of the string 180. Indeed, in this embodiment, no temporary barrier is presented relative the port 440. Thus, pressure within the chamber 410 is roughly equivalent to that of the channel 185 from the outset. As a result, compensation is substantially immediate. Therefore, no noticeable tendency of pressure in the channel 185 emerges to begin forcing the tubulars 425, 450 apart. However, this also means that the differential technique of isolating the chamber 110 to provide a temporary barrier to separation (S), for example, in the face of negligible rises in the offshore platform 200 is also lacking (see FIGS. 1 and 2).

With added reference to FIG. 2, in order to avoid premature separation (S) in the embodiment of FIG. 4A, a gas spring 405 is provided as alluded to above. Thus, in the example above regarding negligible elevating of the platform 200 at the sea surface 205, a barrier to automatic and unregulated separating (S) may be provided. Once more, unlike the rupture disk 145 of FIG. 1, the regulating is ongoing as opposed to a binary, 'on' or 'off' type of regulating. That is, the gas spring 405 operates independent of the compensation chamber 410.

Rather than addressing compensation as detailed hereinabove, the gas spring 405 includes an isolated chamber 415 dedicated to passive and dynamic regulation of the interfacing of the tubulars 425, 450 which define it. For example, as stretch forces are imparted on the joint assembly 100, the rising upper tubular 425 acts to shrink the size of the isolated chamber 415. Thus, fluid pressure in the chamber 415 is increased, for example, as depicted in FIG. 4B. The fluid within the chamber 415 may be a compressible gas such as nitrogen which may or may not be precharged. Accordingly, as the pressure increases, it responsively acts against the separation (S) and encourages the interface 375 to shrink. As such, more negligible, premature forces on the string 180 may be less likely to result in any substantial separation (S). Similarly, the greater the degree of separation (S) the greater the amount of pressure in the isolated chamber 415. Thus, in order to achieve greater separations (S), more significant heaves and rises are presented. Indeed, this correlates well with the type of forces that pose greater concern in terms of potential catastrophic failure of the string 180.

Continuing with specific reference to FIG. 4B, the joint assembly 400 is depicted with the locking mechanism 401 opened. In one embodiment, the mechanism 401 is a hydraulically actuated latch effective at securing over about 1 million lbs. However, a shear pin, rupture disk or other suitable devices may be utilized. Regardless, FIG. 4B reveals a circumstance in which substantial enough outside forces have been presented to result in stroking expansion of the string 180 in spite of compensation provided through the compensation chamber 410. Pressure in the chamber 415 of the gas spring 405 is driven up and yet a noticeable separation (S) persists.

Continuing with reference to FIG. 4B, a stop 420 is provided to ensure that the stroking relative the tubulars 425, 450 ceases at some point. For example, in one embodiment, the expansive function of the joint assembly 400 may eventually give way to other components of the string 180 such as a parting joint and channel closure. That is, at some point forces may be so great as to trigger intentional and controlled breaking of the string 180 in conjunction with emergency valve closure of the channel 185. Along these lines, in one embodiment, pressure within the isolated chamber 415 is monitored on an ongoing basis via conventional techniques. Thus, tension readings on the joint assembly 400 are available on a real-time basis. As such, an operator at the vessel 200 may be provided with a degree of advance warning of emerging structural issues in the string 180.

Figure 5:
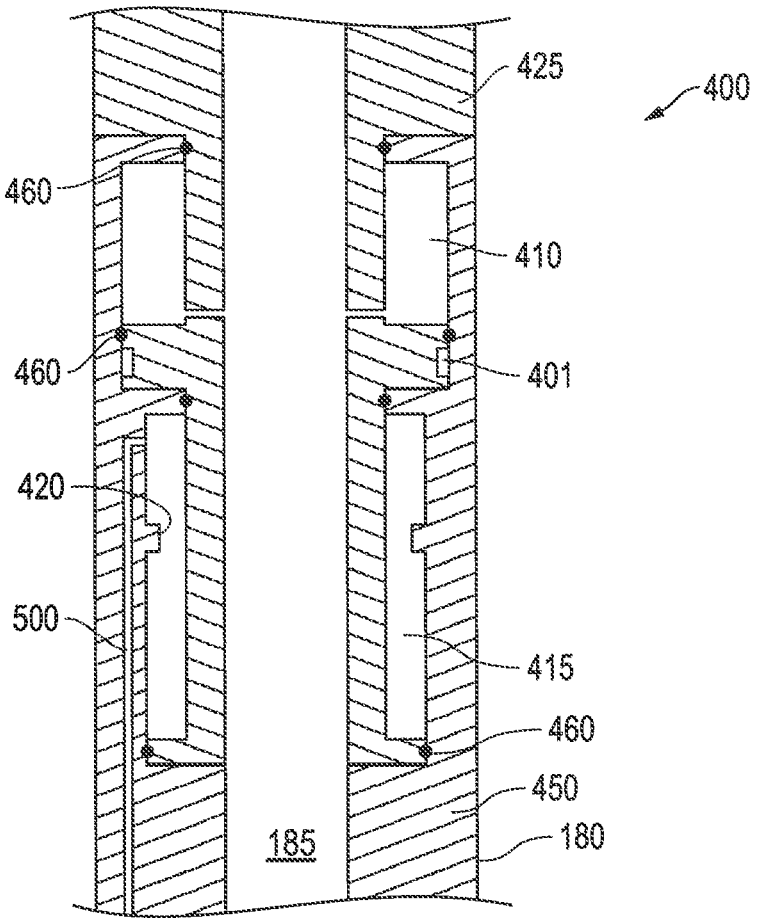
FIG. 5 is an enlarged view of another alternate embodiment of the assembly of FIG. 1 utilizing a compression line running from the gas spring.

Referring now to FIG. 5, with added reference to FIG. 2, another alternate embodiment of the joint assembly 400 is depicted. In this embodiment, a drain line 500 may be run from the isolated chamber 115 to other equipment at the seabed 295 (see FIG. 2). So, for example, in one embodiment, the chamber 115 is equipped with a pressure gauge and relief mechanism such a relief valve. In this manner, once pressure in the chamber 115 reaches above a predetermined level, a signal may be sent over the line to actuate other equipment. Indeed, as alluded to above, a cutter valve to close off all production fluid into the channel 185 may be triggered in this manner. Therefore, as potential failure of the joint assembly 400 and/or the string 180 is detected, a catastrophic event resulting in production fluids flowing up the riser 250 may still be avoided.

Continuing with reference to FIG. 5, the drain line 500 may also be utilized to charge an accumulator for later powering of actuations such as the noted closing of a cutter valve. That is, the draining off of pressurized gas from the chamber 115 may be beneficial even where triggering of an actuator or other functionality is not immediately of benefit. Alternatively, draining in this manner may be used for real-time, though less severe actuations than triggering of a cutter valve. For example, expelled fluid gas from the line 500 may be utilized in a powering sense, as a motile or pumping force for other adjacent equipment.

Figure 6:
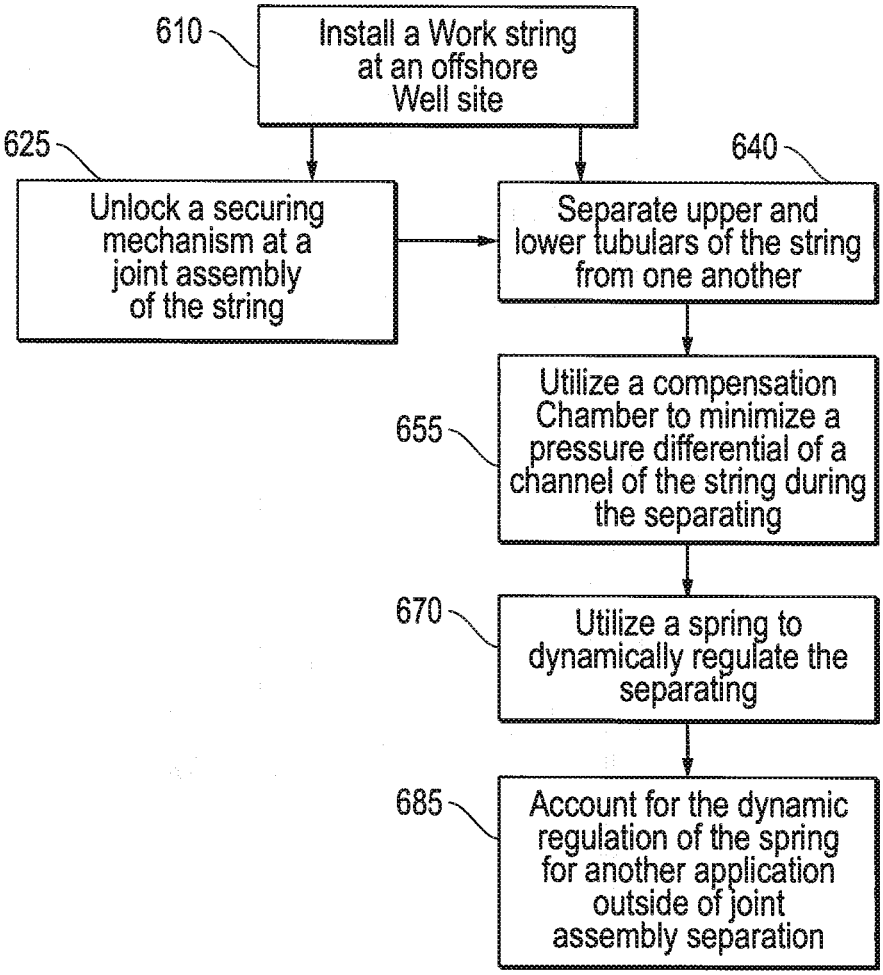
FIG. 6 is a flow-chart summarizing an embodiment of utilizing a tubular joint assembly equipped with passive tension compensator capacity.

Referring now to FIG. 6, a flow-chart summarizing an embodiment of utilizing a tubular joint assembly equipped with passive tension compensator capacity is depicted. Namely, the joint is provided as part of an installed work string at an offshore well site as indicated at 610. Due to the massive weights of equipment, including the string, a locking or securing mechanism may be unlocked as noted at 625 once safe transport and installing is completed. Thus, the joint assembly may be utilized to allow expansion or separating of tubular segments of the string as indicated at 640. Perhaps more notably, however, a compensation chamber may simultaneously be utilized to minimize any pressure differential emerging from the primary channel of the work string (see 655). Thus, the joint assembly may remain effective and avoid any unnecessary premature separating unrelated to heaving of seawater and/or rising of the offshore platform. In one embodiment, this may be aided by way of a temporary barrier to the chamber. Although, more dynamic regulation may be provided as noted below.

Continuing with reference to FIG. 6, additional dynamic regulation as alluded to above may be provided via a spring of the joint assembly as indicated at 670. Indeed, this may be a gas spring which readily avails itself to added functionality such as the triggering or powering of other downhole actuations apart from the joint assembly separation (see 685).

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A passive compensating joint assembly for deployment in an offshore environment, the assembly comprising:

a first tubular portion for coupling to an offshore platform at a sea surface;

a second tubular portion for coupling to a well at a seabed;

a compensation chamber defined by said tubulars at an expansive coupling interface therebetween, said compensation chamber compensating for movement of the first portion relative to the second portion and compensating a pressure differential relative to a production channel disposed within said tubulars through the assembly and in communication with the well, said compensation chamber further being coupled with the production channel via a port to enable movement of the first tubular portion with respect to the second tubular portion while compensating for differential pressure between the compensation chamber and the production channel in a manner which reduces the tendency for internal pressure to bias apart the first tubular portion and the second tubular portion; and a rupture disk located at the port for isolating said compensation chamber in advance of the compensating.

2. The assembly of claim 1 wherein said production channel is of a given pressure and said isolated compensation chamber is pre-charged to a chamber pressure based on the given pressure.

3. The assembly of claim 1 further comprising a spring at the coupling interface between said portions for regulating expansive movement therebetween.

4. The assembly of claim 3 wherein said spring is a gas spring.

5. The assembly of claim 4 wherein said gas spring comprises an isolated chamber of compressible nitrogen.

6. The assembly of claim 1 further comprising a locking mechanism at the coupling interface between said portions to prevent premature expansive movement therebetween.

7. An offshore production assembly comprising:

a well at a seabed;

an offshore platform positioned over the well at a sea surface;

a string tubular with a production channel therethrough and in communication with said well, said tubular having a first portion coupled to said platform and a second portion coupled to equipment at said well;

a passive compensator joint whereat the first and second portions interface one another in an expansive manner; and a compensation chamber of said passive compensator joint, said compensation chamber to compensate for movement of the first portion relative to the second portion and to minimize a pressure differential relative to the production channel via a port extending inwardly from the compensation chamber to the production channel, wherein said passive compensator joint comprises a gas spring chamber at the interface of the portions, the assembly further comprising a drain line running from said spring to the equipment at the well wherein said drain line is configured for one of signaling, charging, and powering of the equipment based on pressure in said gas spring chamber.

8. The assembly of claim 7 wherein said platform is a floating vessel.

9. The assembly of claim 7 further comprising a tubular riser with a first end secured to said platform and a second end secured at said well, said string tubular running through said riser.

10. The assembly of claim 9 further comprising an umbilical line disposed in an annulus between said string tubular and said tubular riser.

11. The assembly of claim 10 wherein said umbilical is slacked to accommodate the expansive nature of said passive compensator joint.

12. A method of regulating responsively expansive movement of a string tubular with a passive tension compensator joint, the method comprising:

coupling first and second portions of the string tubular at the joint;

a passive compensator joint whereat the first and second portions interface one another in an expansive manner; and utilizing a compensation chamber of the joint to compensate for movement of the first portion relative to the second portion and to minimize a pressure differential relative to a production channel via a port extending inwardly from the compensation chamber to the production channel, wherein said passive compensator joint comprises a gas spring chamber at the interface of the portions, the gas spring chamber fluidly communicating with a drain line running from said spring to equipment at a well wherein said drain line is configured for one of signaling, charging, and powering of the equipment based on pressure in said gas spring chamber; and allowing expansive separation of the portions relative one another during the minimizing.

13. The method of claim 12 further comprising unlocking a securing mechanism at the joint between the portions prior to said allowing.

14. The method of claim 12 further comprising compressing a dynamic spring of the joint prior to said allowing.

15. The method of claim 14 further comprising employing said compressing of said dynamic spring to regulate expansive movement between the first and second tubular portions.

* * * * *